US005951134A

United States Patent [19]

Braun et al.

[11] Patent Number: 5,951,134

[45] Date of Patent: Sep. 14, 1999

[54] TWO PIECE COLLAR BIN

[75] Inventors: Patrick A. Braun, Newburgh; Trent A. Stone, Evansville, both of Ind.

[73] Assignee: Whirlpool Corporation, Benton Harbor, Mich.

[21] Appl. No.: 08/423,067

[22] Filed: Apr. 17, 1995

[51] Int. Cl.[6] ..... A47B 96/00

[52] U.S. Cl. ..... 312/405.1; 211/126; 312/401; 312/404

[58] Field of Search ..... 211/88, 126; 312/405.1, 312/404, 407, 408, 410, 401, 440.4; 220/4.01, 480; 108/27; 49/498.1, 490.1

[56] References Cited

U.S. PATENT DOCUMENTS

| | | | |
|---|---|---|---|
| D. 344,739 | 3/1994 | Edman et al. | D15/89 |
| 2,656,933 | 10/1953 | Pierie | 211/88 |
| 2,898,173 | 8/1959 | Squire | 312/248 |
| 3,469,711 | 9/1969 | Swaneck et al. | 211/176 |
| 3,512,696 | 5/1970 | Ebert | 211/126 X |
| 3,534,866 | 10/1970 | Asenbauer | 211/126 |
| 3,734,341 | 5/1973 | Levenhagen | 211/126 X |
| 3,937,537 | 2/1976 | Dietterich | 312/204 |
| 4,322,006 | 3/1982 | Marschak | 211/126 X |
| 4,349,113 | 9/1982 | Schreiner | 211/126 X |
| 4,859,010 | 8/1989 | Jeziorowski | 312/312 |
| 4,921,315 | 5/1990 | Metcalfe et al. | 312/321.5 |
| 4,923,260 | 5/1990 | Poulsen | 312/214 |
| 5,022,537 | 6/1991 | Henriquez | 211/126 X |
| 5,160,191 | 11/1992 | Holland et al. | 312/405.1 |
| 5,303,563 | 4/1994 | Bishop et al. | 62/382 |
| 5,346,299 | 9/1994 | Werkmeister et al. | 312/408 X |
| 5,366,284 | 11/1994 | Baker et al. | 312/404 |
| 5,437,503 | 8/1995 | Baker et al. | 312/404 |

*Primary Examiner*—Peter M. Cuomo
*Assistant Examiner*—Stephen Vu
*Attorney, Agent, or Firm*—Thomas J. Roth; Robert O. Rice; Joel M. Van Winkle

[57] ABSTRACT

A two piece bin for mounting to a refrigerator door having a transparent container portion and surrounding collar portion welded thereto, the collar portion having a portion on a front side being tubular for a light weight yet sturdy structure. The bin having an indented width to interfit within the vertical columns of the refrigerator door and an outwardly extending portion abutting an exposed end face of the vertical columns, the tubular portion of the collar arranged around this outward portion to be abutted to the vertical columns.

19 Claims, 3 Drawing Sheets

TWO PIECE COLLAR BIN

BACKGROUND OF THE INVENTION

The present invention relates to container construction, and particularly to a construction of a refrigerator door bin for use in refrigerator/freezer compartments.

Refrigerator door tray or bin assemblies are previously known from U.S. Pat. No. 4,859,010; U.S. Pat. No. 3,469,711; U.S. Pat. No. 2,898,173; and U.S. Pat. No. 4,921,315. However, U.S. Pat. Nos. 4,859,010 and 4,921,315 disclose unitary containers, that is, containers formed of one material including the bin portion and the collar portion. U.S. Pat. Nos. 2,898,173 and 3,469,711 disclose two level constructed containers having upper portions and lower portions connected together at a flange.

SUMMARY OF THE INVENTION

It is an object of the present invention to provide a new method and article of manufacture, for forming a refrigerator door bin. It is an object of the present invention to provide a two piece plastic bin having respectively two different color plastics. It is an object of the present invention to provide a sturdy and rigid bin for a refrigerator door. It is an object of the present invention to provide a bin for a refrigerator door which is resistant to impact damage and which provides the required strength and durability, yet is light weight and cost effectively manufactured. It is an object of the invention to provide a door bin of plastic having a transparent container portion and an opaque sturdy collar portion surrounding the container portion, the opaque collar portion providing impact protection and rigidity to the bin and providing a hand gripping region where finger prints are less noticeable than on the transparent portion.

It is an object of the invention to provide a door bin which does not easily dislodge from its receiving space in the refrigerator door even though the bin has a depth greater than the receiving space in the door.

The objects of the invention are achieved in that a two piece bin structure and method of manufacturing thereof is provided. The bin is designed as a two piece welded assembly. Therefore, the flexibility of producing a two color door bin, particularly an opaque colored collar piece with a clear container portion, is increased. The objects are achieved in that a collar portion of the door bin is produced using a "gas assisted" injection molding process to produce a hollow beam construction for a front portion of the collar, providing increased strength along an area more susceptible to impact caused by a closing of the door against a protruding object within the refrigerator compartment.

The objects of the invention are also achieved in that the bin is provided with locking tabs to retain the bin in its receiving space allocated in the refrigerator door. The door can be provided with laterally spaced apart columns having protrusions for engaging the locking tabs. The locking tabs are arranged on a back side of the bin extending downwardly.

DETAILED DESCRIPTION OF THE PREFERRED EMBODIMENTS

Figure 1:
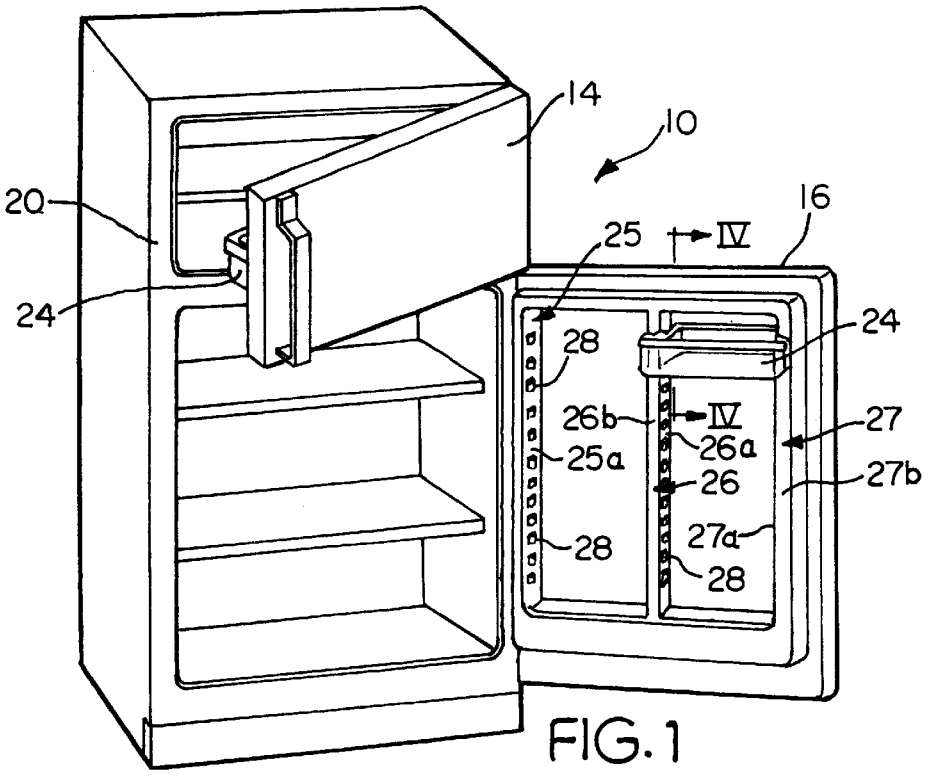
FIG. 1 is a perspective view of a refrigerator/freezer utilizing the door bin of the present invention.

FIG. 1 illustrates a refrigerator/freezer 10 with freezer door 14 and a refrigerator door 16 shown open from the cabinet 20. Arranged on either or both of the doors 12, 14 are door bins 24. Although a vertically stacked refrigerator/freezer is shown, the door bins 24 are also applicable to side-by-side refrigerator/freezer. The bins 24 (one shown) can be supported on vertical walls 25, 26, 27 on the refrigerator door 16. Protrusions 28 are provided on inwardly directed surfaces 25*a*, 26*a*, 27*a* of the walls 25, 26, 27 respectively to support bins 24 at selected elevations on the door 16 as described below.

Figure 2:
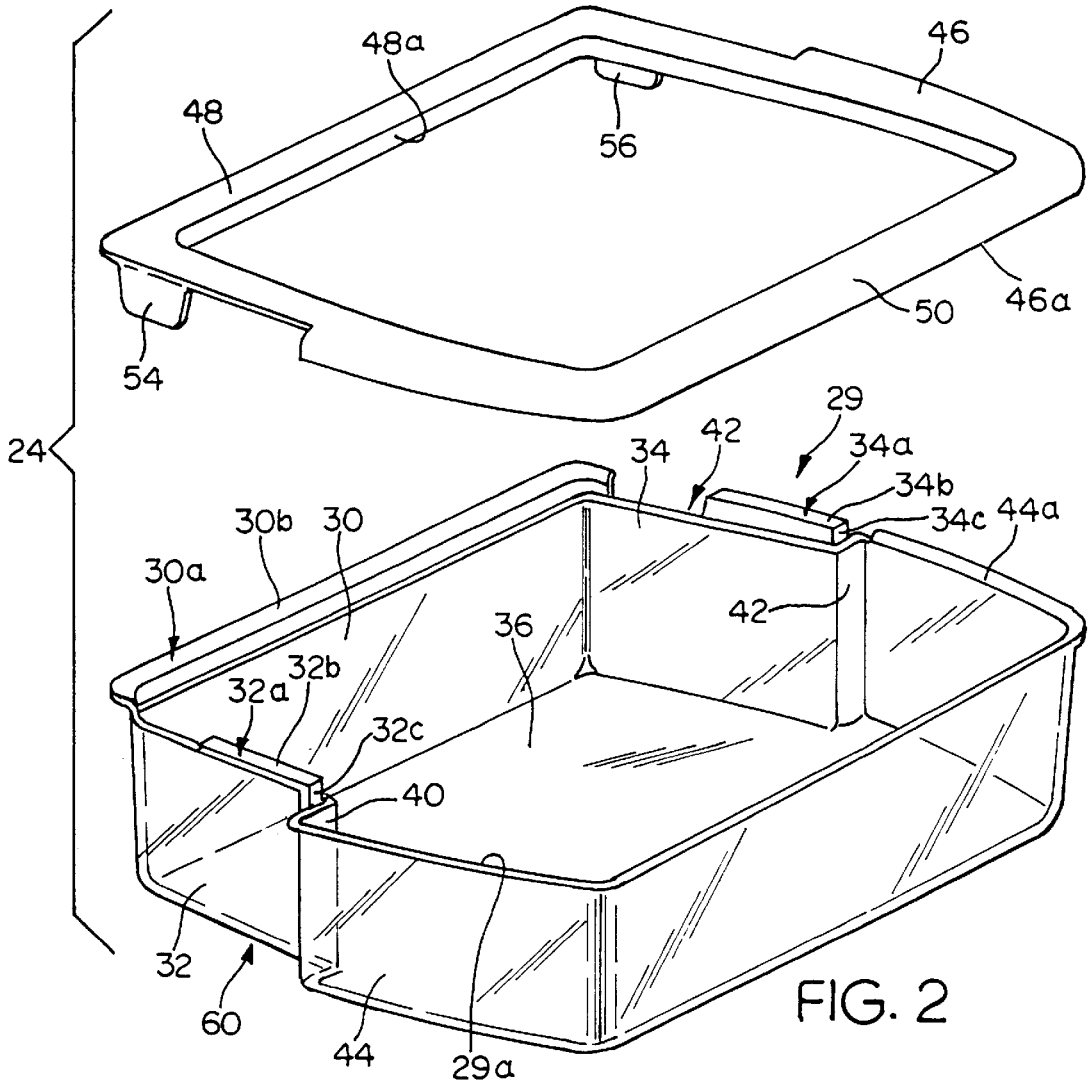
FIG. 2 is a exploded perspective view of a door bin as shown in FIG. 1.

FIG. 2 shows a bin 24 having a container portion 29 having a generally rectangular rear section defined by a rear wall 30, a left side wall 32, a right side wall 34, and a floor 36. A front section is formed by the floor 36, a left lateral wall 40 and a right lateral wall 42 connected to an arcuate front wall 44 having a generally elongate C-shape.

A collar 46 having an overall horizontal profile matching the container portion 29 is placed thereon and is bonded by an adhesive or plastic welded, such as ultrasonically welded, to the container portion. The collar 46 provides a C-shaped elongate flange 48 having an inverted L-shaped cross section, integrally formed with an opposing elongate C-shaped trim 50 having an enclosed, hollow cross section. The collar 46 has an open face 46*a* which substantially matches an open face 29*a* of the container portion 29. The collar 46 also provides tabs 54, 56 extending downwardly from the flange region on opposite lateral sides of the bin 24, for mounting the bin 24 to the selected refrigerator space. The lateral walls 40, 42 create indented areas or pockets 60, 62 on opposite lateral sides of the bin 24 which receive two walls 26, 27 of the refrigerator door. The rear wall 30 extends at an upper edge into an L-shaped flange 30*a* with a horizontal leg 30*b*. The sidewall 32 extends at an upper edge into an L-shaped flange 32*a* with a horizontal leg 32*b* and an end cap 32*c*. The opposite sidewall 34 extends upward into an L-shaped flange 34*a* with a horizontal leg 34*b* and an end cap 34*c*. The flanges 32*a*, 34*a* are arranged adjacent the lateral walls 40, 42 respectively. The arcuate wall 44 extends at an upper edge into an outwardly turned lip 44*a*. The horizontal legs 30*b*, 32*b*, 34*b* flushly abut an underside 48*a* (FIG. 7) of the flange 48 for plastic welding thereto to connect the collar 46 to the container portion 28. The trim 50 is plastic welded to the lip 44*a*.

Figure 3:
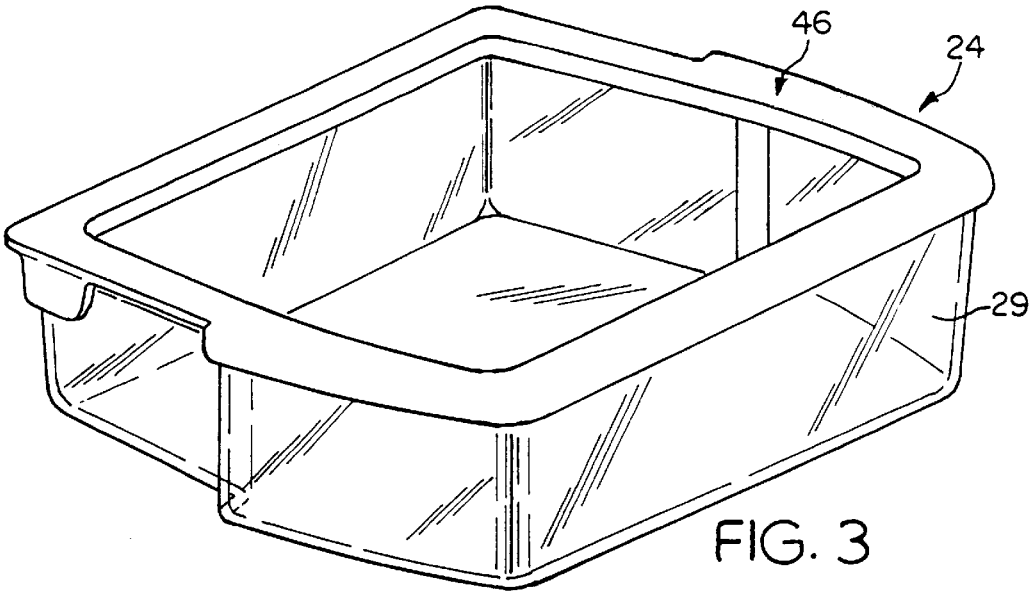
FIG. 3 is a perspective view of the door bin of FIG. 2 in assembled condition.

FIG. 3 shows the bin 24 in assembled condition with the collar 46 bonded to the container portion 29. In the preferred embodiment, the container portion 29 is transparent and the collar 46 is opaque and color coordinated with the refrigerator compartment.

Figure 4:
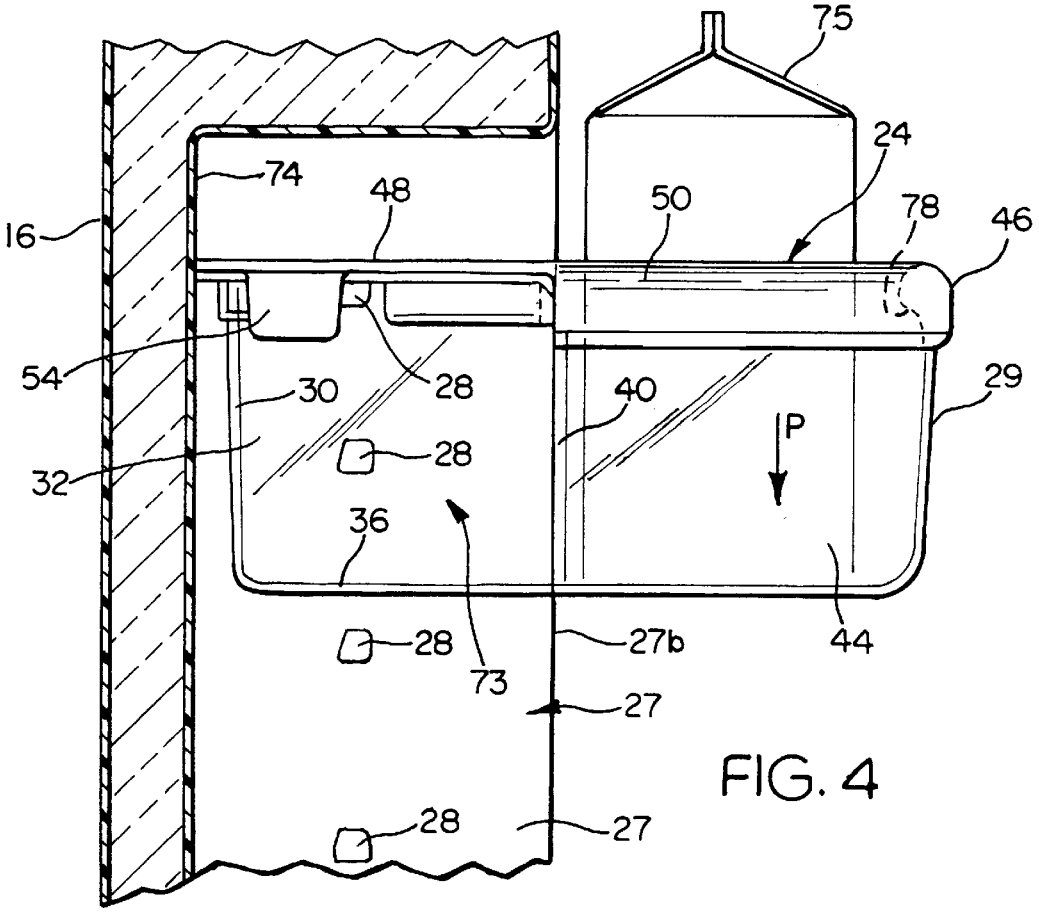
FIG. 4 is a partial sectional view taken generally along IV—IV of FIG. 1 showing the installed door bin in side elevation.

FIG. 4 illustrates the bin 24 installed into the door 16. The tabs 54, 56 are arranged to tightly engage against two selected opposing protrusions 28 of the door 16 (see FIG. 1). The tabs 54, 56 prevent forward retraction of the bin 24 out of the door 16. The bin 24 is held tightly between the protrusions 28 and a front surface 26*b*, 27*b* of the walls 26, 27 respectively. To install the bin 24, the bin is tilted to insert the tabs 54, 56 behind the protrusions 28.

Figure 5:
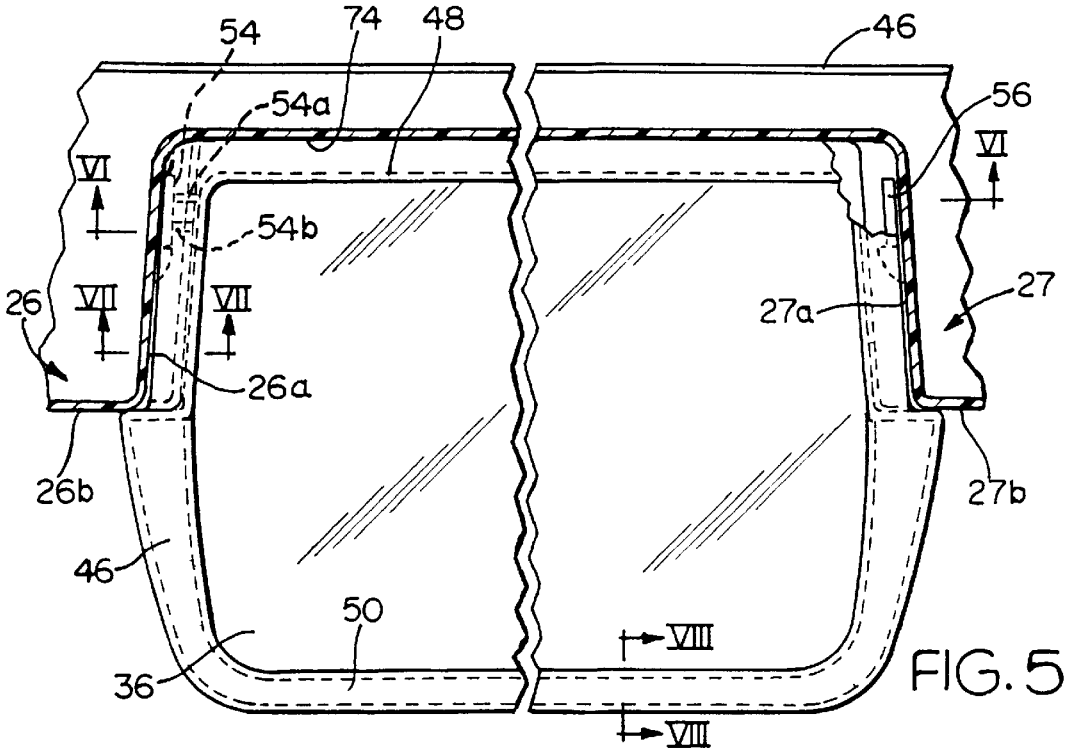
FIG. 5 is a plan view of the door bin as shown in FIG. 1.

FIG. 5 illustrates the bin 24 in place in the door 16. The tabs 54, 56 are engaged behind the protrusions 28. The protrusions have a tapered profile from front to back to assist in installing the bin 24.

The clamping of the protrusions 28 and the door surfaces 26*b*, 27*b* between the tabs 54, 56 and the lateral walls 40, 42 of the bin 24 allows the bin 24 to extend substantially outwardly from the front surfaces 26*b*, 27*b* of the walls 26, 27 while resisting overturning. This provides a bin 24 which has a capacity greatly exceeding a space 73 allocated in the door 16 defined by the horizontal dividers 69, the vertical walls 26, 27 and a back wall 74 of the door 16. Also, larger items such as milk containers 75 and large condiment jars can be stored in the bin 24 which otherwise would be too large or tall for the space 73.

Figure 6:
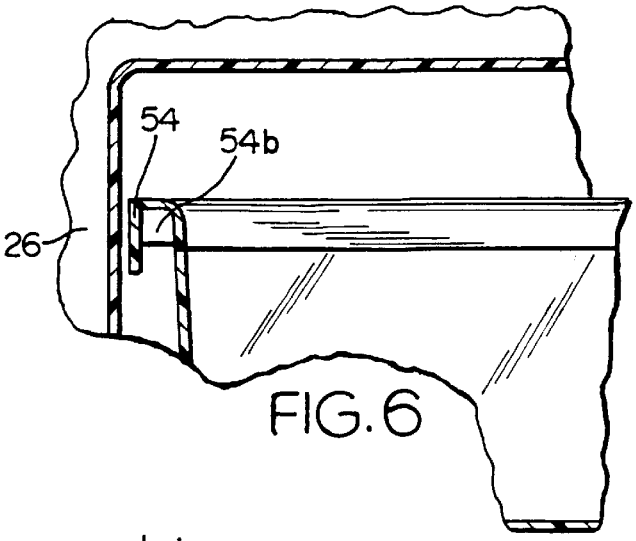
FIG. 6 is a partial sectional view taken generally along VI—VI of FIG. 5.
Figure 7:
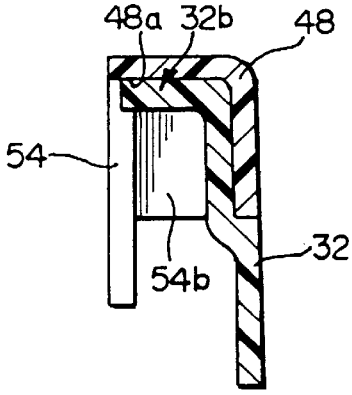
FIG. 7 is a sectional view taken generally along line VII—VII of FIG. 5.

FIGS. 5, 6 and 7 illustrate that the tab 54 has parallel gusset stiffeners 54*a,b* perpendicular to the tab 54. The tab 56 has identical stiffeners arranged in mirror image to the stiffeners 54*a,b*.

Figure 8:
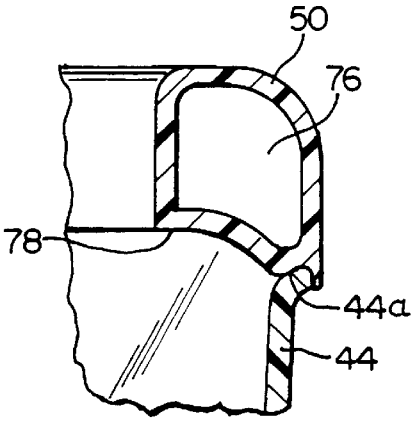
FIG. 8 is a partial sectional view taken generally along VIII—VIII of FIG. 5.

FIG. 8 shows a section of the front generally C-shaped trim 50 which extends between the lateral walls 40, 42. The trim 50 is substantially hollow with a void 76 therein. The trim 50 is formed using a gas assisted injection molding process. The trim 50 thus forms a sturdy yet light weight surrounding member which is crush and dent resistant and provides a convenient and easy grasping handle for removing the bin 24. If the trim 50 is opaque, finger smudges are less observable than would otherwise be observed on a transparent surface.

Figure 9:
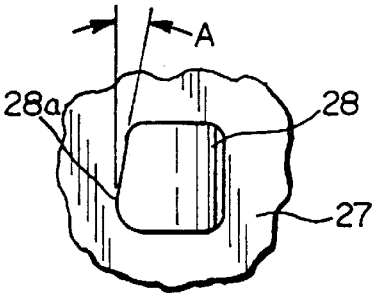
FIG. 9 is an enlarged partial side view of a protrusion as shown in FIG. 4.

FIG. 9 illustrates the advantageous shape of the protrusion 28 for locking the tabs 54, 56 against the door 16. The protrusions 28 are generally rectangular but with an inclined trailing face 28*a* for locking against the tabs 54, 56. The angle A is preferably $10° \mp 10°$.

The invention is particularly advantageous in that the container portion 29 can be injection molded of a transparent material and the collar 46 to be secured thereto can be formed of an opaque material using the gas assisted injection molding process. The container portion 29 can be made with a more conventional injection molding process and is readily molded because of its open shape as contrasted to the finished shape of the bin 24 which may have an overhanging lip formed by the collar 46. Thus, the bin 24 can be advantageously formed by injection molding while still retaining an inwardly directed lip 78 for retaining articles within the bin 24. The collar 46 provides an increased structural rigidity to the container portion 29 through the advantage of gas assisted molding to create the hollow beam member. A two piece molding process allows that the collar 46 can be color coordinated with the remaining refrigerator cabinetry while retaining a substantially transparent bin.

Although the present invention has been described with reference to a specific embodiment, those of skill in the art will recognize that changes may be made thereto without departing from the scope and spirit of the invention as set forth in the appended claims.

We claim as our invention:

1. A bin for mounting to a refrigerator door, comprising:

a plastic container portion having an open top face; and a plastic collar having an overall profile to match the open face of said container portion and a front trim portion having an impact resistant hollow enclosed beam construction, and said collar bonded to said open face of said container portion.

2. The bin according to claim 1, wherein said collar is formed of an opaque plastic and said container portion comprises a transparent plastic.

3. The bin according to claim 1, wherein said collar comprises an inside profile extending at least partially within an inside profile of said container portion, said container portion having no inward protrusions from said open top face for ease of injection molding.

4. The bin according to claim 1, wherein said hollow enclosed beam construction is a one piece injection molded construction.

5. The bin according to claim 1, wherein said collar comprises a flange portion having an L-shaped cross section molded integrally to said front trim portion, said flange portion and said front trim portion forming an approximate rectangle; and tabs extending downward from said flange portion to engage protrusions on said door.

6. The bin according to claim 1, wherein said collar comprises a flange portion connected to said front trim portion, said flange portion and said front trim portion forming an approximate rectangle; said container portion having at least one upwardly extending L-shaped flange bonded by a plastic weld to said collar.

7. The bin according to claim 6, wherein said container portion has an outwardly turned lip welded to said front trim portion.

8. A bin for mounting to a refrigerator door, comprising:

a plastic container portion having an open top face;

a plastic collar surrounding said open top face and bonded thereto, said plastic collar having a hollow beam construction across an exposed front side of said collar;

and tabs extending downward from said collar portion to engage protrusions on said door.

9. The bin according to claim 8, wherein said collar comprises a flange portion having an L-shaped cross section molded integrally to said front trim portion, said flange portion and said front trim portion forming an approximate rectangle.

10. The bin according to claim 8, wherein said container portion has a tapered rear profile to interfit within a space defined by lateral columns of the refrigerator door, and an expanded front profile to extend laterally overlying the lateral column of the refrigerator door.

11. The bin according to claim 8, wherein said beam construction is a hollow enclosed one piece injection molded construction.

12. The bin according to claim 8, wherein said collar comprises an inside profile extending at least partially within an inside profile of said container portion, said container portion having no inward protrusions from said open top face for ease of injection molding.

13. The bin according to claim 8, wherein said collar is formed of an opaque plastic and said container portion comprises a transparent plastic.

14. A bin for mounting to a refrigerator door, comprising:

a plastic container portion having an open top face;

a plastic collar having an overall profile to match the open face of said container portion and a front trim portion having an impact resistant hollow enclosed beam construction across an exposed front side of said collar, said collar further having tabs extending downwardly to engage protrusions on said door, and said collar bonded to said open face of said container portion.

15. The bin according to claim 14, wherein said collar comprises a flange portion having an L-shaped cross section molded integrally to said front trim portion, and said flange portion and said front trim portion forming an approximate rectangle.

16. The bin according to claim 14, wherein said container portion has a tapered rear profile to interfit within a space defined by lateral columns of the refrigerator door, and an expanded front profile to extend laterally overlying the lateral column of the refrigerator door.

17. The bin according to claim 14, wherein said collar comprises an inside profile extending at least partially within an inside profile of said container portion, said container portion having no inward protrusions from said open top face for ease of injection molding.

18. The bin according to claim 14, wherein said hollow enclosed beam construction is a one piece injection molded construction.

19. The bin according to claim 14, wherein said collar is formed of an opaque plastic and said container portion comprises a transparent plastic.

* * * * *